US006469728B1

(12) United States Patent
Charnitski et al.

(10) Patent No.: US 6,469,728 B1
(45) Date of Patent: Oct. 22, 2002

(54) LED PRINTBARS WITH DEPTH OF FOCUS ENHANCEMENT

(75) Inventors: George A. Charnitski, Fairport, NY (US); Thomas J. Hammond, Penfield, NY (US); Donald E. Wiedrich, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 1317 days.

(21) Appl. No.: 08/573,845

(22) Filed: Dec. 18, 1995

(51) Int. Cl.[7] ..... B41J 15/14; B41J 27/00
(52) U.S. Cl. ..... 347/244
(58) Field of Search ..... 347/244, 241, 347/134; 257/88, 91, 98

(56) References Cited

U.S. PATENT DOCUMENTS 4,349,248 A 9/1982 Rees ..... 350/413
4,982,222 A 1/1991 Rees ..... 355/1
5,245,355 A * 9/1993 Morton et al. ..... 347/118
5,421,589 A * 6/1995 Monroe ..... 273/473
5,444,520 A * 8/1995 Murano ..... 347/244
5,450,157 A 9/1995 Rees ..... 355/1
5,477,024 A * 12/1995 Share et al. ..... 219/121.69

OTHER PUBLICATIONS

"Industrial optics light control film"; 3M; 3 pages.

* cited by examiner

*Primary Examiner*—Thinh Nguyen
(74) *Attorney, Agent, or Firm*—John M. Kelly; David E. Henn

(57) ABSTRACT

A printbar assembly comprised of an array of light emitters, and array of gradient index lenses, and a light control film. The light control film, which is comprised of a plurality of microlouvers, is disposed such that it limits the angle at which light from the light emitters can enter the gradient index lenses. The light control film increases the depth of focus of the gradient index lens array without significantly reducing the effective radiometric efficiency.

10 Claims, 5 Drawing Sheets

LED PRINTBARS WITH DEPTH OF FOCUS ENHANCEMENT

FIELD OF THE INVENTION

The present inventions relates to imaging systems which include LED printbars comprised of light emitting elements and gradient index lenses.

BACKGROUND OF THE INVENTION

Light transmitters comprised of bundled gradient index optical fibers or rods are known in the art. For example, U.S. Pat. No. 3,658,407, issued Apr. 25, 1972 to Ichiro Kitano et al., and entitlted "Image Transmitter Formed of a Plurality of Graded Index Figers in Bundled Configuration," describes a light conducting rod made of glass or synthetic resin which has a cross sectional refractive index distribution that varies parabolically outward from a center portion. The rods act as focusing lenses for light introduced at one end. Such lenses are produced under the trade name "SELFOC;" a name which is owned by Nippon Sheet Glass Company, Ltd. Relevant optical characteristics of gradient index lens arrays are described in an article entitled "Optical properties of GRIN fiber lens arrays: dependence on fiber length", by William Lama, *Applied Optics,* Aug. 1, 1982, Vol. 21, No. 15, pages 2739–2746.

Gradient index lens arrays are useful in document imaging systems. For example, they are frequently used in the imaging systems of electrostatographic printers which use LED print bars. In that application the gradient index lenses are disposed between the light elements of the LED print bar and the photoreceptor surface so as to focus the light from the light elements into light spots on the photoreceptor surface.

In most imaging applications it is important that the gradient index lenses have an adequate depth of focus. Otherwise, small changes in the relative positions of the gradient index lenses and the surface of interest will cause relatively large changes of the object at the image point. Indeed, it is usually desirable that the depth of focus of a gradient index array be as large as possible while meeting the radiometric efficiency requirements.

FIG. 1 is useful in explaining several important concepts. The illustrated conventional lens L1 has an exit pupil diameter $D_1$, a focal length FL, and a depth of focus DOF. The f/# of lens L1 is the focal length FL divided by the diameter of the exit pupil, or:

$$f/\#=FL\div D_1.$$

As is well known, the depth of focus of a conventional lens can be increased by increasing its relative aperture (or f/#). It is also well known that an increase in the depth of focus results in a reduced radiometric efficiency. Two relationships explain the trade-off of an increase in the depth of focus and a reduction in radiometric efficiency for conventional lenses. First, the radiometric efficiency is inversely proportional to $(f/\#)^2$. Second, the depth of focus is directly proportional to the f/#. For example, the depth of focus (DOF') of the lens L2 of FIG. 2 is greater than that of the depth of focus of the lens L1 since the lens L2 has a smaller exit pupil diameter $D_2$. This is true even though the focal lengths (FL) of lenses L1 and L2 are the same. However, since the radiometric efficiency equals $(f/\#)^2=(D/FL)^2$, the radiometric efficiency for the lens L2 is less than that of the lens L1. Simply put, while the depth of focus of a lens can be increased by reducing the relative aperture, the price to be paid is a loss in radiometric efficiency. Likewise, radiometric efficiency can be increased, but only with a reduction in the depth of focus.

However, for gradient index lenses it can be shown that the radiometric efficiency is proportional to $(n_o\sqrt{A}\times R)^2$, where $n_o$ is the axial refractive index of the optical rods, $\sqrt{A}$ is a constant which depends upon the gradient index of the lens, and R is the radius of the rods. Additionally, it can be shown that the depth of focus of a gradient index lens is inversely proportional to $n_o\sqrt{A}\times R$.

Significant to the present invention is the fact that the gradient index lenses currently used in imaging applications usually produce asymmetrical, generally elliptical, spots. Usually, the elongated axis of the spots are aligned in the cross-process direction (the imaged surface moves in the process direction).

U.S. Pat. No. 5,450,157 entitled, "Imaging System Using A Gradient Index Lens Array With Improved Depth of Focus," issued on Sep. 12, 1995 to James D. Rees taught an imaging system which uses improved gradient index lenses. Those improved lenses were constructed such that the exit pupil of the lenses were symmetrical and such that the quantity $n_o\sqrt{A}\times R$ is decreased to achieve the radiometric efficiency. While the lenses taught in U.S. Pat. No. 5,450,157 are beneficial, in practical terms they may not be optimal. This is true since the gradient index lenses taught in that patent must be specially formed.

Therefore, a technique which increases the depth of focus of a common gradient index lens while maintaining acceptable imaging radiometric efficiency would be advantageous.

SUMMARY OF THE INVENTION

The present invention provides for an improved gradient index lens assembly. That assembly is comprised of an array of asymmetric gradient index lenses for focusing light from an object plane into a focal plane, and a light control film inserted between the object plane and the gradient index lens. The light control film is comprised of microlouvers which block light entering at angles greater than a cut-off angle. The limited angle at which light can enter the gradient index lens increases the effective depth of focus of that lens. Beneficially, the light control film is disposed directly onto the gradient index lens array.

BRIEF DESCRIPTION OF THE DRAWINGS

Other aspects of the present invention will become apparent as the following description proceeds and upon reference to the drawings, in which.

In the drawings, like numbers designate like elements, Additionally, the text includes directional signals which are taken relative to the drawings (such as right, left, top, and bottom). Those directional signals are meant to aid the understanding of the present invention, not to limit it.

DETAILED DESCRIPTION OF THE PREFERRED EMBODIMENTS

Figure 3:
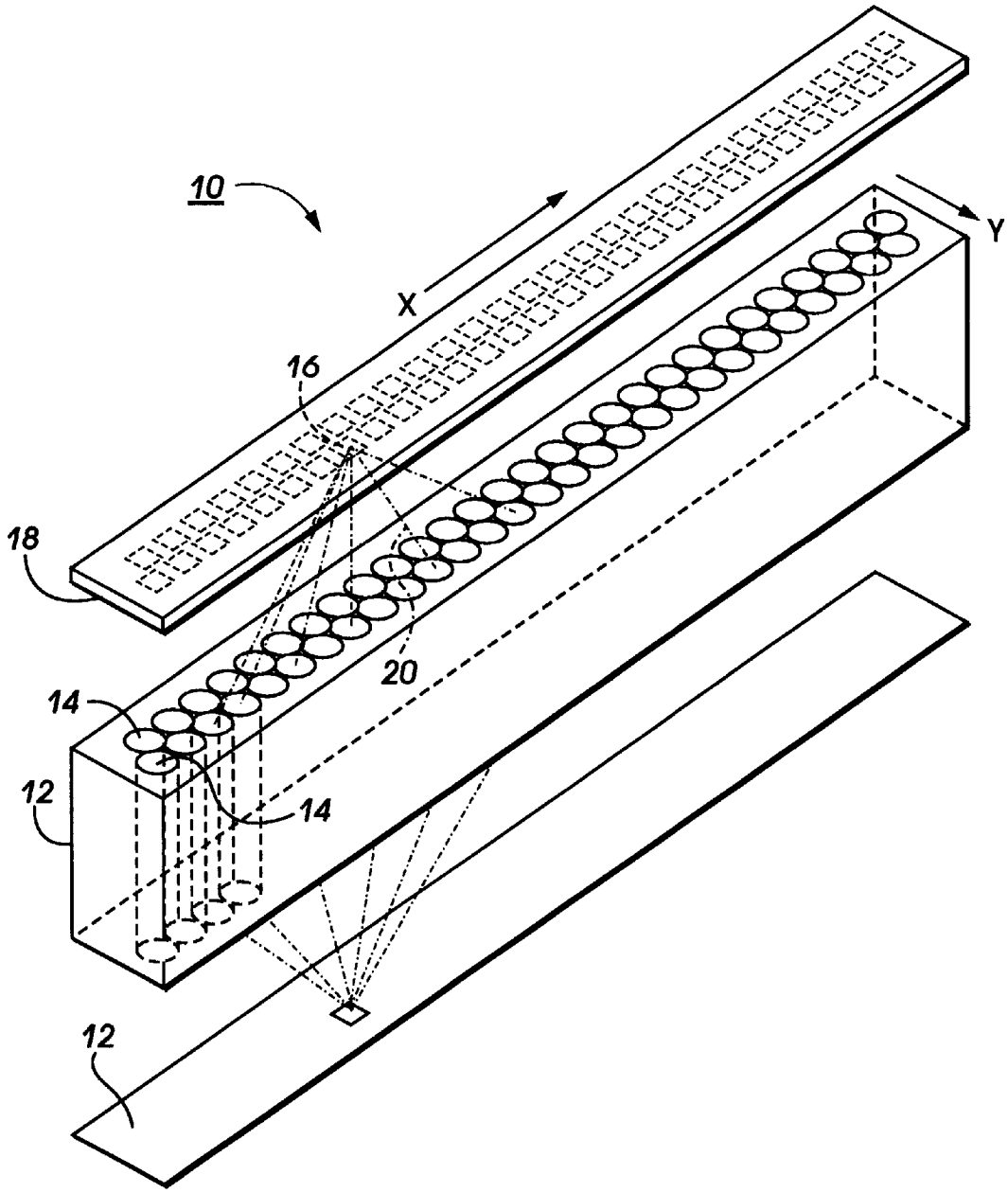
FIG. 3 PRIOR ART
FIG. 3 schematically depicts a prior art LED printbar having a gradient lens array.

To understand the present invention is is helpful to first understand the prior art LED printbar 10 depicted in FIG. 3. As shown, the printbar 10 is comprised of an array of gradient index lenses 12 (in the general shape of rods) having a top surface 14. For illustrative purposes the lenses are commercial SLA 9 SELFOC lenses which have radiometric efficiencies of 0.72% and an f/# of f/2.8. The gradient index lenses are comprised of identical rods which have the same optical properties. However, as previously noted, the effective exit aperture (or pupil) of gradient index lenses are usually asymmetric, being much larger in the array (X) direction than in a cross-array (Y) direction. Thus it is to be understood that the exit apertures of the lenses 12 are greater in the X direction than in the Y direction.

Shown above the lenses 12 are a plurality of LED light emitting elements 16 which are located in an object plane 18. In practice there are many more light emitting elements than lenses. Light 20 from the light emitting elements, only one light emitting element shown emitting light, pass through one or more lenses 12 and are focused into an image plane 22. Since the lenses 12 produce non-inverted images the light from ON light emitting elements produce spots in the image plane. The total exposure of a point in the image plane 22 for light emanating from a point in the object plane 18 is a summation of the exposure values of each of the rods.

Figure 1:
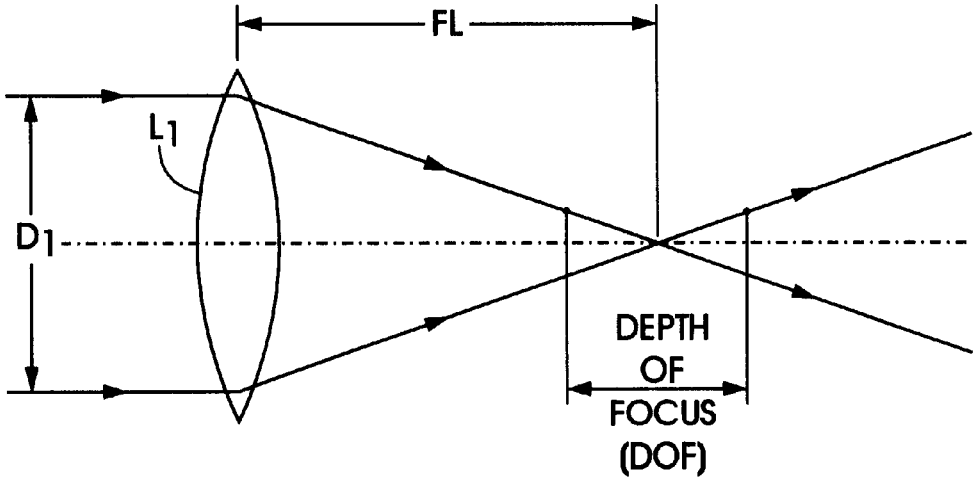
FIG. 1 PRIOR ART
FIG. 1 illustrates a prior art lens L1 and the relationship between that lens's aperture, focal length, and depth of focus.
Figure 2:
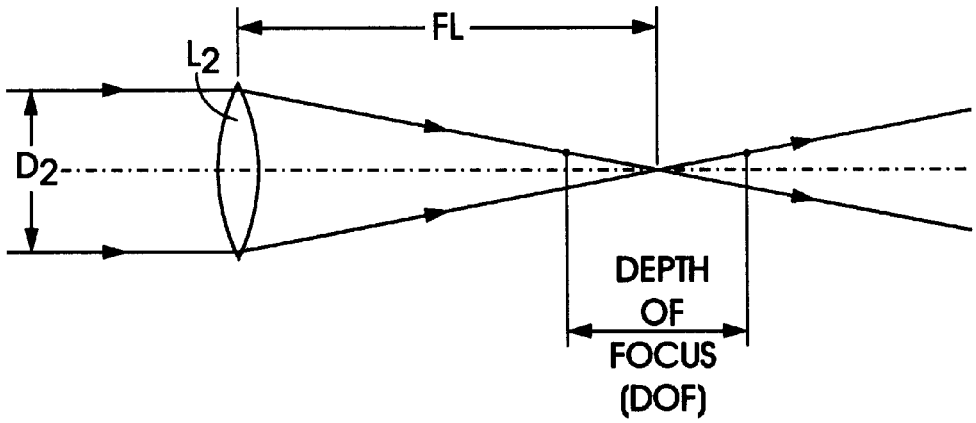
FIG. 2 PRIOR ART
FIG. 2 illustrates a prior art lens L2 and the relationship between that lens's aperture, focal length, and depth of focus.

As previously described the radiometric efficiency and the depth of focus of a gradient index lens array are both associated with the product $n_o\sqrt{A}\times R$, and that product usually depends upon the axis of interest. However, unlike in conventional optical lenses (see FIGS. 1 and 2) the effective depth of focus of an asymmetrical gradient index lens can be increased while maintaining the effective radiometric efficiency. A device which achieves this desirable result is shown in FIG. 4.

Figure 4:
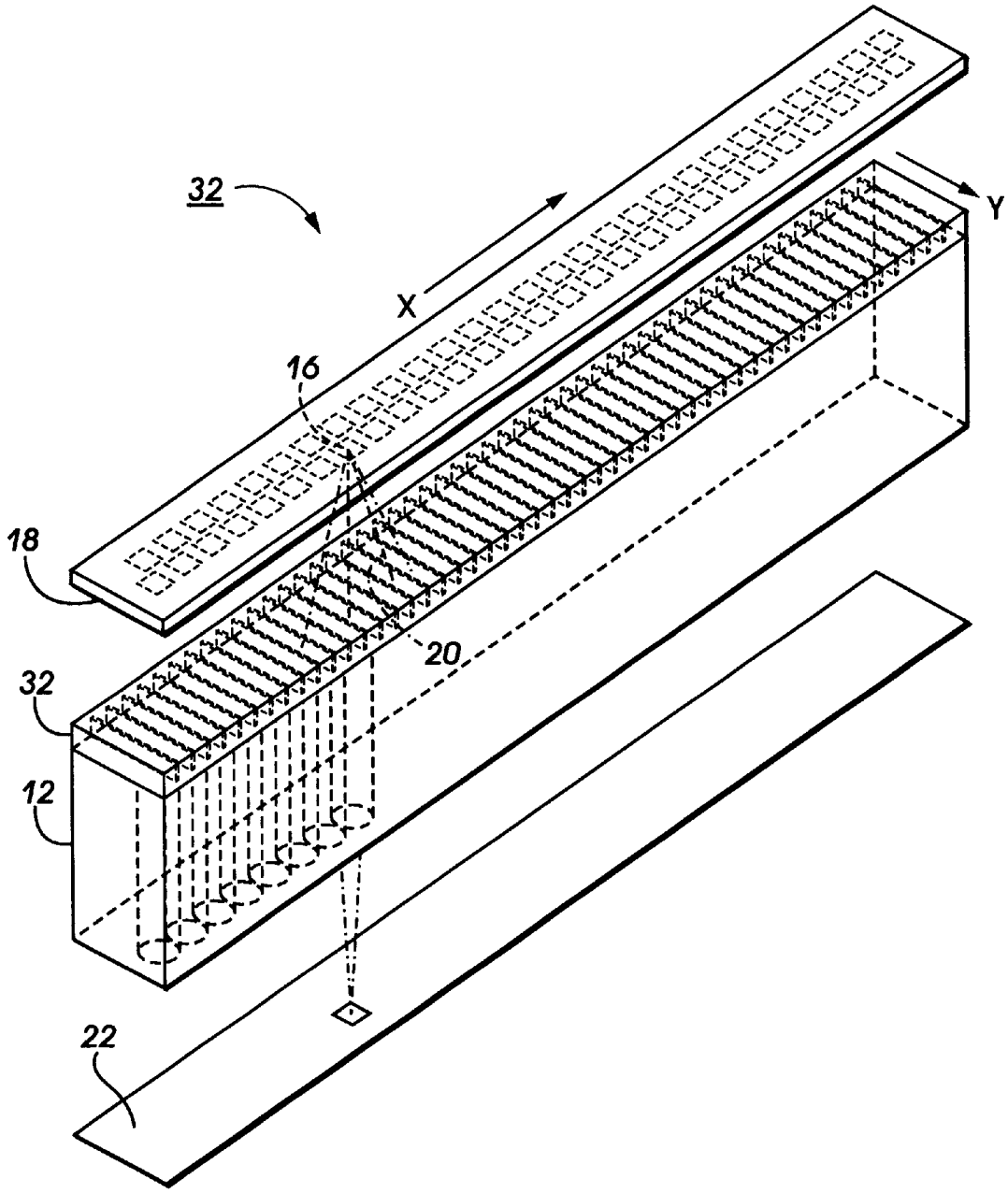
FIG. 4 schematically depicts an LED printbar according to the principles of the present invention.

FIG. 4 shows an LED printbar 30 which is similar to the LED printbar 10, except for the insertion of a light control film 32 between the light emitting elements 16 and the gradient index lenses 12. Beneficially, the light control film is placed on the top surfaces 14 (shown in FIG. 3, understood as being beneath the light control film in FIG. 4).

Figure 5:
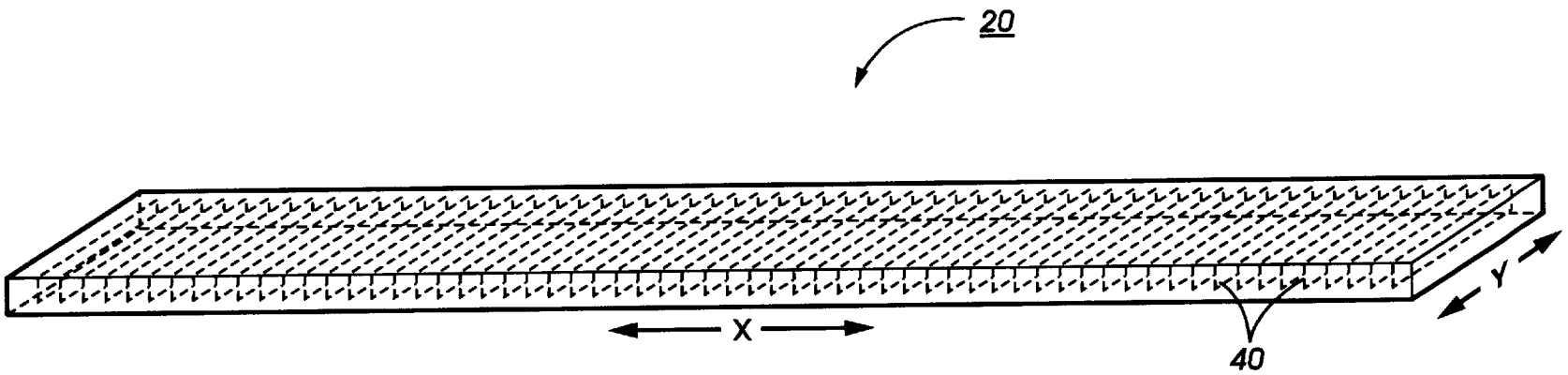
FIG. 5 schematically depicts a section of light control film.

The light control film is beneficially a member of, or similar to a member of, the line of Industrial Optics Light Control Films produced by 3M. Those films are thin plastic films containing closely spaced black microlouvers. Those films simulate tiny venetian blinds that block light from unwanted angles. FIG. 5 shows a schematic representation of the light control film 32. As shown, the light control film is comprised of a plurality of microlouvres 40 which run in the Y direction. When the light control film 32 is inserted as shown in FIG. 4 the microlouvers act to limit the number of lenses used to form a light image in the image plane 22. This acts to decrease the effective aperture of the lens and improves the depth of focus in the X direction. Test show that a considerable increase in the depth of focus in the X direction can be achieved with virtually no change in the other process direction imaging characteristics.

Figure 6:
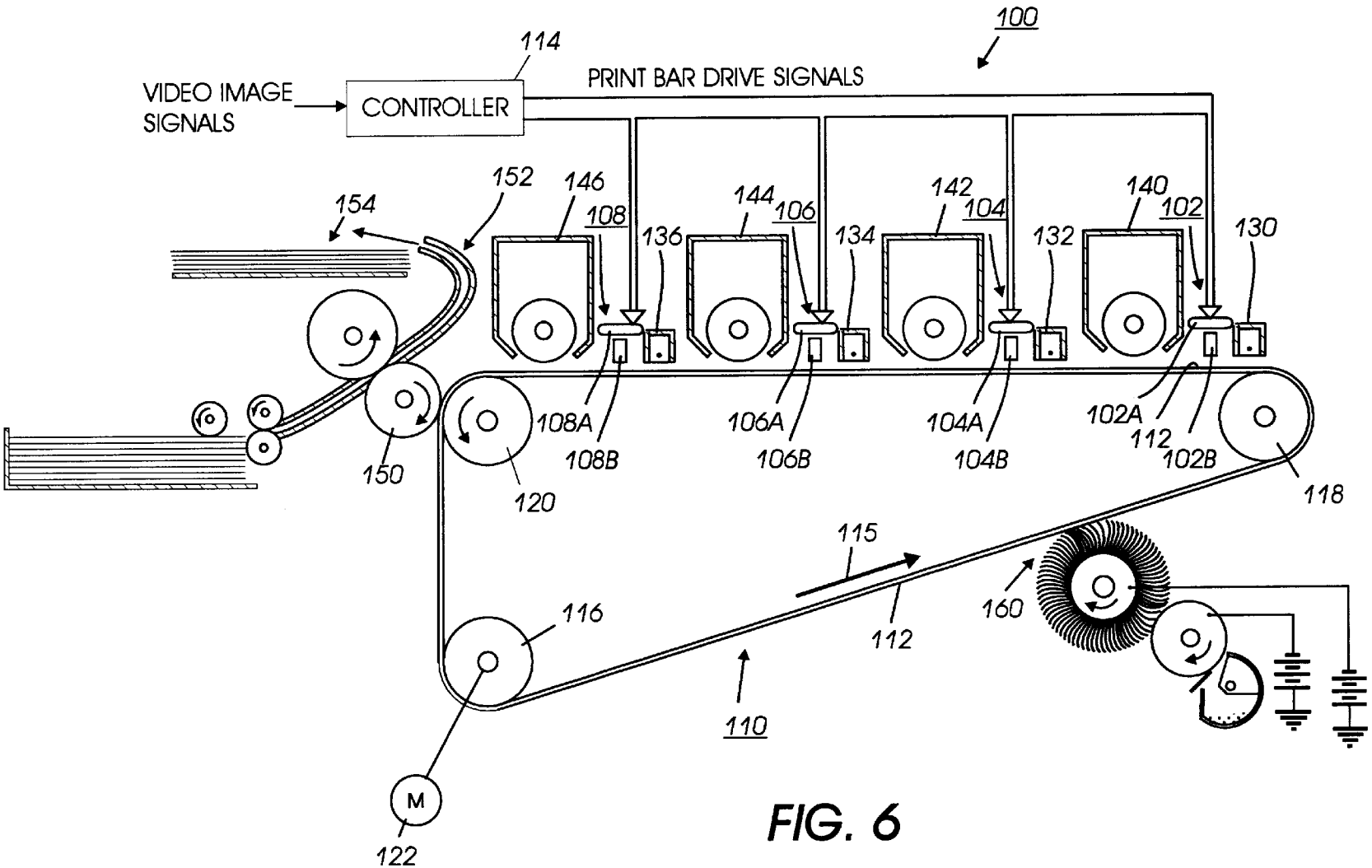
FIG. 6 schematically depicts a single pass, four color electrophotographic printing machine which incorporates the principles of the present invention.

The LED printbar 30 can be used in a number of applications. For example, FIG. 6 schematically depicts a single pass, four color electrophotographic printing machine 100 which uses the LED printbars 30. The illustrated printing machine has four exposure stations, the exposure stations 102, 104, 106, and 108; a belt 110 which has a photoreceptive surface 112; and a controller 114. Each exposure station includes an LED printbar 30 as shown in FIG. 4 and as described above. The LED arrays of the printbar 30 are shown in FIG. 6 as the LED arrays 102A, 104A, 106A, and 108A, while the gradient index lenses 12 and the light control film 20 are shown in FIG. 6 as lens arrays 102B, 104B, 106B, and 108B. The LED printbars selectively expose the photoreceptive surface 112 in accordance with printbar drive signals from the controller 114 so as to produce a desired latent image on the photoreceptive surface. Each exposure station produces a latent image for a different color of toner. For example, the exposure station 102 might produce a latent image for black toner, the exposure station 104 might produce a latent image for cyan toner, the exposure station 106 might produce a latent image for yellow toner, and exposure station 108 might produce a latent image for magenta toner.

The belt 110 is designed to accept an integral number of full page latent image areas. An image area is that part of the belt which is operated on by the various process stations so as to produce a developed image. In operation the belt travels in the direction indicated by the arrow 115 such that as the belt travels the surface position of the belt 110 is controlled to within about 25 $\mu$m. Belt travel is brought about by mounting the belt about a drive roller 116 and two tension rollers, the rollers 118 and 120, and then rotating the drive roller via a drive motor 122.

Upstream of each exposure station are charge devices, the charge devices 130, 132, 134, and 136. Those charge devices place a predetermined electrical charge on the image areas of the photoreceptive surface 112. As the belt rotates each image area moves past its charging device to the next downstream exposure Station. As previously mentioned the printbars expose the photoreceptive surface in accordance with printbar drive signals. Those printbar drive signals are produced by the controller 114 in response to input video image signals. The input video image signals may be from any of a large number of sources, including a raster input scanner, a computer, or a fax machine. The printbar drive signals are synchronized to begin when the leading edge of an image area reaches a transverse start-of-exposure position. The printbar drive signals represent exposure patterns for a plurality of closely spaced transverse scan lines of a single color. As the photoreceptive surface travels printbar drive signals for new transverse scan lines are applied to the LED printbar and new scan lines are imaged onto the photoreceptive surface.

Downstream from each exposure station is an associated development station, the development stations 140, 142, 144, and 146. Those development stations develop the latent image produced by the adjacent upstream exposure station without disturbing any previously developed image. The developed toner images are then sequentially transferred in superimposed registration from the belt 110 onto an output sheet 154 within a transfer station 152. After the last toner layer is transferred onto the output sheet the composite toner image is fused by a fuser 158. After the photoreceptor passes the transfer station 152 the image areas are cleaned of residual toner and other debris at a cleaning station 160. The image areas are then ready to produce another latent image. Further details of xerographic stations in a multiple exposure single pass system are disclosed in U.S. Pat. No. 4,666,059, entitled, "Color Printing Machine," issued Apr. 21, 1987 to O'Brien, and in U.S. Pat. No. 4,833,503, entitled, "Electronic Color Printing System with Sonic Toner Release Development," issued May 23, 1989 to Snelling.

It is to be understood that while the figures and the above description illustrate the present invention, they are exemplary only. Others who are skilled in the applicable arts will recognize numerous modifications and adaptations of the illustrated embodiments which will remain within the principles of the present invention. Therefore, the present invention is to be limited only by the appended claims.

What is claimed:

1. A printbar assembly comprised of:

an array of light emitters for emitting light;

an array of gradient index lenses for receiving light from said array of light emitters and for focusing the received light into an image plane, wherein each gradient index lens receives light from a plurality of light emitters; and a light control film comprised of a plurality of microlouvers, said light control film disposed such that the microlouvers block light emitted from a light emitter from being received by a gradient index lens.

2. The printbar assembly according to claim 1, wherein said light control film is disposed between said array of light emitters and said array of gradient-index lenses.

3. The printbar assembly according to claim 1, wherein said array of light emitters are substantially aligned along a first axis, and wherein said light control film is disposed such that said microlouvers are aligned substantially perpendicular to said first axis.

4. The printbar assembly according to claim 1, wherein said light emitters are light emitting diodes.

5. A printer,, comprising:

a photoreceptive surface;

a charging station for charging said photoreceptive surface to a predetermined potential;

a plurality of light emitting sources aligned, each of said light emitting sources for emitting light;

a plurality of gradient index lenses for receiving light emitted from said plurality of light emitting sources and for focusing the received light onto a charged photoreceptive surface wherein a latent image is produced;

a light control film comprised of a plurality of microlouvers, said light control film disposed such that the microlouvers block light emitted from a light emitter from being received by a gradient index lens;

a first development station for depositing a first developing material on the latent image so as to produce a toner image;

a fusing station for fusing the toner image onto a substrate; and a cleaning station for cleaning the photoreceptive surface of residual toner.

6. The printer according to claim 5, wherein said light emitting sources are light emitting diodes.

7. The printer according to claim 5, wherein said light control film is disposed between said plurality of light emitting sources and said plurality of gradient index lenses.

8. A color printer, comprising:

a photoreceptive surface;

at least one charging station for charging said photoreceptive surface to a predetermined potential;

a first light emitter array comprised of a plurality of light emitting sources, each of said light emitting sources for emitting light;

a first lens array comprised of a plurality of gradient index lenses for receiving light emitted from said first light emitter array and for focusing the received light onto said photoreceptive surface to create a first latent image;

a first light control film comprised of a plurality of microlouvers, said light control film disposed such that the microlouvers block light emitted from a light emitting source of said first light emitter array from being received by a gradient index lens of said first lens array;

a first development station for depositing a first developing material on the first latent image;

a second light emitter array comprised of a plurality of light emitting sources, each of said light emitting sources for emitting light;

a second lens array comprised of a plurality of gradient index lenses for receiving light emitted from said second light emitter array and for focusing the received light onto said photoreceptive surface to create a second latent image;

a second light control film comprised of a plurality of microlouvers, said light control film disposed such that the microlouvers block light emitted from a light emitting source of said second light emitter array from being received by a gradient index lens of said second lens array;

a second development station for depositing a second developing material on the second latent image;

a fusing station for fusing the first and second toner images onto a substrate; and a cleaning station for cleaning the photoreceptive surface of residual toner.

9. The electrophotographic printer according to claim 8, wherein said first light emitter array is comprised of light emitting diodes.

10. The electrophotographic printer according to claim 8, wherein said first light control film is disposed between said first light emitter array and said first lens array.

* * * * *